United States Patent [19]

Gross

[11] 4,158,154

[45] Jun. 12, 1979

[54] DELAY LINE FOR TRANSIT TIME AMPLIFIER TUBES

[75] Inventor: Franz Gross, Munich, Fed. Rep. of Germany

[73] Assignee: Siemens Aktiengesellschaft, Berlin & Munich, Fed. Rep. of Germany

[21] Appl. No.: 840,495

[22] Filed: Oct. 7, 1977

[30] Foreign Application Priority Data

Dec. 6, 1976 [DE] Fed. Rep. of Germany ... 7638147[U]

[51] Int. Cl.[2] ..... H01J 25/34

[52] U.S. Cl. ..... 315/3.5; 315/3.6; 315/39.3; 330/43

[58] Field of Search ..... 315/3.5, 3.6, 39.3; 330/43

[56] References Cited

U.S. PATENT DOCUMENTS

| | | | |
|---|---|---|---|
| 3,274,428 | 9/1966 | Harris | 315/3.6 |
| 3,576,460 | 4/1971 | Harman | 315/3.5 |
| 3,846,664 | 11/1974 | King et al. | 315/3.5 |
| 4,013,917 | 3/1977 | Horigome et al. | 315/3.5 |
| 4,053,810 | 10/1977 | James | 315/3.6 |
| 4,066,927 | 1/1978 | Gross | 315/3.5 |

*Primary Examiner*—Saxfield Chatmon, Jr.
*Attorney, Agent, or Firm*—Hill, Van Santen, Steadman, Chiara & Simpson

[57] ABSTRACT

A delay line for transit time amplifier tubes which has a filter characteristic with a negative dispersion in the fundamental wave of the longest pass band, i.e. the operating band, in the form of a hollow conductor which is provided with successive transverse walls, each of which is provided with an electron beam opening and a coupling slot, and an attenuation path which is provided with lossy material, in the zone of which at least one of the line dimensions which determines the two cutoff frequencies of the operating band is so increased that, in the attenuation path, at least one of the two cutoff frequencies of the operating band possesses at least the same distance from the band center as in the remainder of the delay line, with the operating band being determined by the dimensions of the coupling slots, while in the attenuation zone, in which primarily the electric fields of the line wave are attenuated ("field attenuation"), the coupling slots are reduced in size in the region of the attenuation path in such manner that the upper cutoff frequency of the operating band is at least equal to that in the remainder of the delay line. Preferably, annular transverse partition walls are in each case disposed between adjacent transverse walls, with the inner diameters of the partition walls being additionally increased in the area of the attenuation path.

3 Claims, 3 Drawing Figures

DELAY LINE FOR TRANSIT TIME AMPLIFIER TUBES

BACKGROUND OF THE INVENTION

The invention is directed to a delay line for transit time amplifier tubes, which has a filter characteristic with negative dispersion in the fundamental wave of the longest wave pass band, i.e. the operating band, and is formed from a hollow conductor provided with successive transverse walls, each of which is provided with an electron beam opening and a coupling slot. An attenuating path which is provided with a lossy material and in the area of which at least one of the conductor dimensions which determines the two cutoff frequencies of the operating band, is so enlarged that, in the attenuation path, at least one of the two cutoff frequencies of the operating band lies at least at the same distance from the band center as in the remainder of the delay line. A line of this general type is known from German Pat. No. 2,400,331.

The patent referred to is concerned, in particular, with a type of line whose operating band is determined by the dimensions of the line cells and whose attenuation path is so designed that it fundametally affects only the magnetic field of the line wave (cavity line with current attenuation). In a line of this type, assuming equal dimensions along the entire length of the line, in the attenuating portion in particular, the lower cutoff frequency is displaced towards higher values so that undesired reflections readily occur during operation in the vicinity of the $\pi$-point. The patent thus proposes that the cell diameters or the length of the coupling slots be increased.

If the attenuation path influences the magnetic field of the line wave to a lesser extent than the electric field (field attenuation), then the attenuating elements will influence the dispersion characteristic of the delay line in an entirely different manner. In this case the attenuation component is well matched at the $\pi$-point, whereas disturbing oscillations are generated close to the 2 $\pi$-point.

BRIEF SUMMARY OF THE INVENTION

The invention has among its objects to provide an arrangement operative to suppress the interference modes caused by field attenuation at the upper band edge in an arrangement whose operating band is determined not by the dimensions of the cavity but by the slot lengths, i.e. the slot coupling lines. The stabilization is to be achieved by simple means and, where required, is also to render the system oscillation-free in the vicinity of the $\pi$-point.

These objectives are achieved in a line of the type referred to that where the operating band is determined by the dimensions of the coupling slots, and at the same time primarily the electric fields of the line wave are attenuated in the attenuation path, the coupling slots being so shortened in the area of the attenuation path that the upper cutoff frequency of the operating band is at least equal to that in the remainder of the delay line.

The effects of the proposed variation of slot lengths may be explained as follows:

In a field-attenuated slot coupling line exhibiting anomalous dispersion, the undesired band edge oscillations occur because field-attenuating elements displace the pass band towards lower frequencies and therefore a line resonator can form in the vicinity of the 2 $\pi$-point, between the attenuation portion and the vacuum window which has a strongly reflective effect at such frequencies. As can be confirmed by tests, a reduction in the coupling slot will lead to a characteristic change in the dispersion curve which could virtually be referred to as a shift towards higher frequencies, i.e. shorter wavelengths. The upper cutoff frequency in particular is also strongly increased, an effect which by no means so marked in cavity lines. The extent of the band shift is fundamentally dependent upon the degree of reduction in the slot length, so that the misadjustment caused by the attenuation can be fundamentally reversed.

If it were desired to additionally increase the stability of the tube by means of an additional widening of the band in the attenuation path, the other dimensions of the attenuated line cells, in particular the diameter thereof, could also be varied. In a line cell having annular transverse partition walls between adjacent transverse walls, such type of widening can be carried out very simply, it being sufficient to slightly increase the inner diameter of the transverse partition walls. The proposed rule for dimensioning leads not only to a wide band matching but also, as clearly established on experimental tubes, enables an improved interaction in the path. The result is a more intensive focussing of the beam and a reduction of the transit time of the electron bundles in the field-free space.

BRIEF DESCRIPTION OF THE DRAWINGS

In the drawings wherein like reference characters indicate like or corresponding parts.

DETAILED DESCRIPTION OF THE INVENTION

Figure 1:
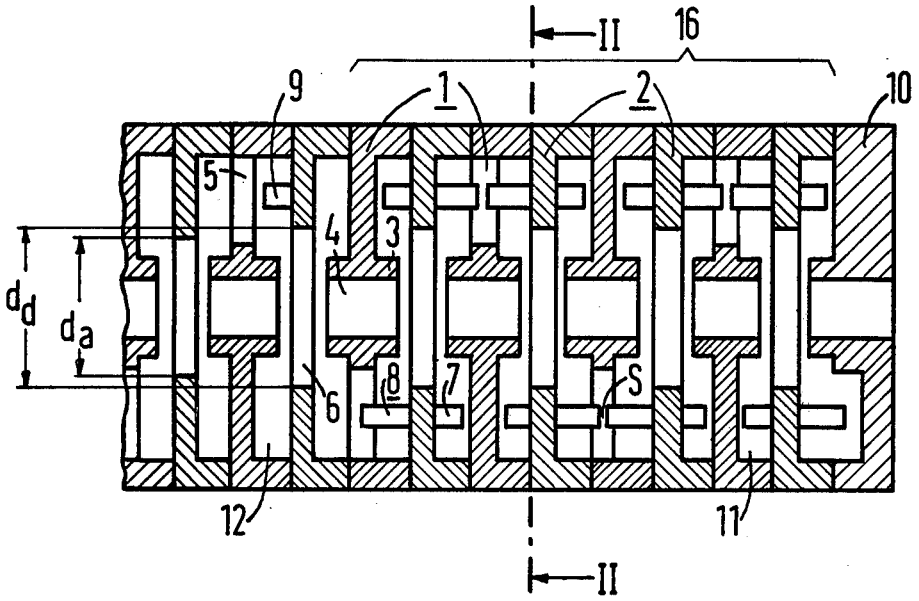
FIG. 1 is a longitudinal sectional view of a delay line in accordance with the invention.

The delay line illustrated in FIG. 1 is adapted to be employed in a travelling wave tube for the amplification of mm-waves, and comprises of a plurality of respective portions which are separated from one another with respect to high frequencies. FIG. 1 illustrates only one of such portions and in fact primarily illustrates only that part thereof which comprises the attenuation path. The length of the attenuation path is designated by a curved bracket designated by the reference numeral 16.

The line portion comprises a plurality of transverse walls 1 and transverse partition walls 2 which are alternately arranged, with the portion being terminated by a so-called sever 10. Both the transverse walls and the transverse partition walls are each provided with a peripheral circular flange and thus are spaced from one another without the need for additional spacing components. The transverse walls, partition walls and sever may be constructed of copper and are soldered together to form a solid black, i.e. a stack line.

Each transverse wall contains, a centrally disposed beam tube having an electron beam opening 4, and is also provided with a coupling slot 5. The transverse partition walls also are provided with central openings designated by the reference numeral 6. Successive transverse walls each staggered by 180° with respect to one another and the two adjacent transverse walls, in each case, define a line cell 11 which is divided by a transverse partition wall 2.

Figure 2:
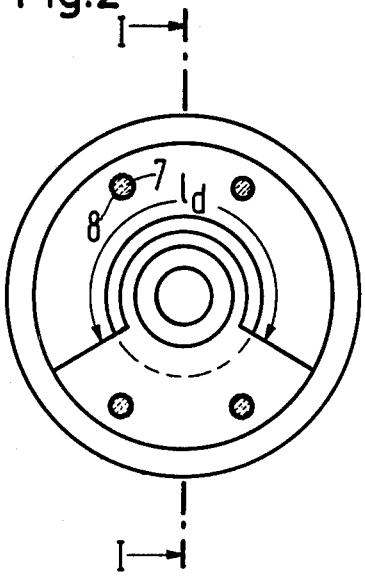
FIG. 2 is a sectional view taken approximately on the line II of FIG. 1.

As illustrated in FIG. 2, the slot lengths are greater than the diameters of the line cells so that in the operating band the line operates with a slot mode. The fundamental wave moves backwards in the operating state, and the line is therefore operated in the first (forward) harmonic.

Carried by the partition walls and disposed in the attenuation path are attenuating cylinders 8, each of the partition walls containing four such cylinders, which may be composed of aluminum oxide, boron nitride, or beryllium oxide and are provided with a thin, high-ohmic resistive layer 7, for example, of carbon. An attenuation arrangement of this type has a field-attenuating action. The line cell, i.e. matching cell 12, which directly precedes the attenuation path contains a metallic pin 9, i.e. matching pin, which produces a low-reflective resistance transformation between the active line components and the attenuation component.

To effect a correction of the dispersion curve in the attenuation path, the lengths of the coupling slots may be shorter, and the inner diameters of the partition walls greater than in the remainder of the line. The inner diameters of the partition walls are designated, in FIG. 1, with the length $d_a$ representing the inner diameter of the partition walls in the active line portion; while the length $d_d$ represents the inner diameter in the attenuation portion with $d_d > d_a$. Likewise, the length of the coupling slot in the attenuation path is represented in FIG. 2 by the line $l_d$.

Figure 3:
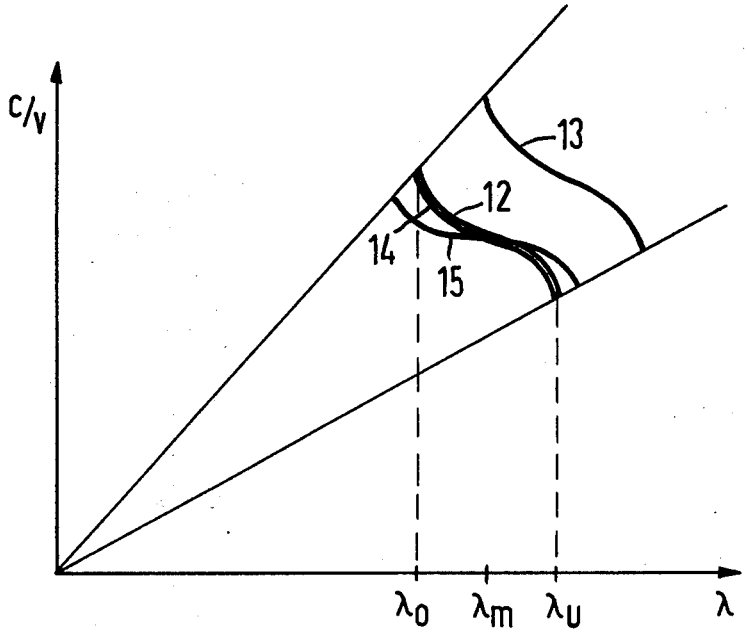
FIG. 3 is a diagram illustrating the influence of a dimensioning in accordance with the invention, upon the dispersion curve of the first harmonic in the operating band.

The diagram of FIG. 3 illustrates the effect of dimensioning changes in accordance with the present invention, in which the value c/v (c=light speed in vacuum and v=phase speed of the line wave) has been plotted over $\lambda$ ($\lambda$=wavelength of the free wave). The curve 12 corresponds to the dispersion arm of the first harmonic in the active line portion with the cutoff wavelengths of the arm being entered on the ordinate and designated $\lambda_o$ and $\lambda_u$. If the dimensions along the entire line were maintained constant, the band would become displaced in the attenuation path towards the right in the direction of longer wavelengths as represented by the curve 13. If the coupling slot lengths are reduced in the attenuation path, such displacement can be virtually reversed as indicated by curve 14, and if the inner diameters of the partition walls are additionally increased in the attenuation portion, the dispersion arm is rotated anticlockwise about an axis in the vicinity of the band center, designated $\lambda_m$. The operating band in such case extends beyond the two cutoff wavelengths as indicated by the curve 15.

The attenuation path matching has two effects, first being that the line no longer inclines towards band edge oscillations and, as already mentioned, has an increased efficiency. In a test line comprising a plurality of portions, the matching of only one attenuation path (input attenuation zone) was sufficient to produce a 3 to 4 dB higher amplification.

The invention is not limited to the represented exemplary embodiment. Other attenuation arrangements thus can be employed, provided they produce a field attenuation rather than a current attenuation. In particular, other slot coupling lines, for example so-called flange lines, also may be employed.

Having thus described my invention, it will be obvious that although various minor modifications might be suggested by those versed in the art, it should be understood that I wish to embody within the scope of the patent granted hereon all such modifications as reasonably and properly come within the scope of my contribution to the art.

I claim as my invention:

1. A transit time tube in which a delay line is provided having a filter characteristic with a negative dispersion in the fundamental wave of the longest wave pass band, which form the operating band, the line being formed from a waveguide assembly provided with consecutive cells formed by transverse walls each possessing an electron beam aperture and a coupling slot, and an attenuation path which is provided with dissipative material and in the region of which at least one of the line dimensions which determine the two cut-off frequencies of the pass bands is increased in such manner that in the attenuation path at least one of the two cut-off frequencies of the operating band possesses at least the same distance from the band centre as in the remainder of the delay line, the operating band being determined by the dimensions of the coupling slots while the electric fields of the line wave are attenuated in the attenuation path, the coupling slots being reduced in size in the region of the attenuation path in such manner that the upper cut-off frequency of the operating band is at least equal to that in the remainder of the delay line.

2. A tube as claimed in claim 1, in which an annular transverse partition wall is arranged between each adjacent pair of transverse walls, the inner diameters of the transverse partition walls being increased in the region of the attenuation path.

3. A delay line according to claim 2, wherein the partition walls in the attenuation path are provided with attenuating members extending transversely to the associated walls.

* * * * *